US007895687B2

(12) United States Patent
Schulte

(10) Patent No.: US 7,895,687 B2
(45) Date of Patent: Mar. 1, 2011

(54) CROSS BAR SYSTEM FOR A BED FRAME

(75) Inventor: John K. Schulte, Lake St. Louis, MO (US)

(73) Assignee: Fredman Bros. Furniture Company, Inc., St. Louis, MO (US)

( * ) Notice: Subject to any disclaimer, the term of this patent is extended or adjusted under 35 U.S.C. 154(b) by 62 days.

(21) Appl. No.: 12/321,588

(22) Filed: Jan. 22, 2009

(65) Prior Publication Data

US 2010/0180378 A1 Jul. 22, 2010

(51) Int. Cl.
*A47C 19/00* (2006.01)

(52) U.S. Cl. ..... 5/201; 5/200.1; 5/203

(58) Field of Classification Search ..... 5/200.1, 5/201, 203

See application file for complete search history.

(56) References Cited

U.S. PATENT DOCUMENTS

| | | | | |
|---|---|---|---|---|
| 4,080,674 | A | 3/1978 | Fredman et al. | |
| 6,625,827 | B1 * | 9/2003 | Polevoy et al. | 5/201 |
| 6,839,920 | B2 * | 1/2005 | Schulte | 5/200.1 |
| 7,219,378 | B2 * | 5/2007 | Polevoy et al. | 5/200.1 |
| 7,503,529 | B2 * | 3/2009 | Bartelsmeyer et al. | 5/207 |
| 7,690,058 | B1 * | 4/2010 | Dwyer et al. | 5/200.1 |
| 2004/0148701 | A1 | 8/2004 | Schulte | |

* cited by examiner

*Primary Examiner* — Robert G Santos
*Assistant Examiner* — Brittany M Wilson
(74) *Attorney, Agent, or Firm* — David H. Chervitz

(57) ABSTRACT

A cross bar system for supporting a bed having a pair of bed rails is disclosed in which the cross bar system comprises a cross bar member, a bracket member for attachment to one of the bed rails with the bracket member for receiving the cross bar member, and a leg member for attachment to the cross bar member for supporting the cross bar member.

20 Claims, 5 Drawing Sheets

CROSS BAR SYSTEM FOR A BED FRAME

BACKGROUND OF THE DISCLOSURE

This disclosure relates to beds and bed frames and more particularly to a cross bar system for bed frames.

Conventional beds may consist of a mattress, a box spring, a headboard, a footboard, a pair of spaced apart bed rails, and longitudinally spaced, transversely extending wooden or metal slats extending between the bed rails. The slats and the bed rails are used to support the mattress and box spring above the floor upon which the bed is positioned. During use, the slats have a tendency to warp, twist, or deflect under the weight of the box spring, the mattress, and the individuals using the bed. Any warping, twisting, or deflecting of the bed rails causes the box spring to sag or droop which leads to an uneven sleeping surface. Also, this is a problem with wider span beds such as queen size and king size width beds. Since the box spring is wider and longer it is heavy and needs better or enhanced support. Further, sagging of the box spring over time may damage the box spring or other bed components which would then need to be replaced.

It is also known that a bed frame may be constructed of various structural members such as side rails and cross members that are connected to the side rails to form a rigid structure that supports a box spring and a mattress. The side rails and the cross members include leg portions that extend downwardly to elevate the structural members above the floor. Each of the leg portions have fitted or inserted therein a glide assembly to provide easy movement of the structural members, the box spring, and the mattress. The side rails may be constructed from wood and the cross members may be constructed from metal. In this particular situation, the cross member has holes drilled in the ends thereof for receiving screws which are screwed into the wooden side rails. However, the point where the wood screws are screwed into the wooden side rails is typically the weakest point and it is here where the bed frame is subject to failure. For example, if the bed frame needs to be repositioned, the stress associated with moving the bed frame is centered where the screws are screwed into the wood side rails. Movement of the cross member will pull the screws out causing damage to the wooden side rails. If this occurs then the entire bed frame may have to be replaced or repaired.

The present disclosure is designed to obviate and overcome many of the disadvantages and shortcomings associated with support systems for bed frames or cross members. In particular, the present disclosure provides a cross bar system for supporting a box spring and a mattress and which reduces stress on bed rails associated with a bed. Moreover, the present disclosure is a cross bar system for supporting a bed frame and a bed. While the present cross bar system is applicable for use with full, queen, kings and California king size beds which require support legs on the cross members or cross bars to support the extra width and weight of such beds and bedding, it is also suitable for use with a twin size bed where support legs may be desired.

SUMMARY OF THE DISCLOSURE

In one form of the present disclosure, a cross bar system for supporting a bed having a pair of bed rails comprises a cross bar member, a bracket member for attachment to one of the bed rails with the bracket member for receiving the cross bar member, and a leg member for attachment to the cross bar member for supporting the cross bar member.

In another form of the present disclosure, a cross bar system for supporting a bed having a pair of bed rails comprises an L-shaped cross bar member having a horizontal flange, a vertical flange, a first end, and a second end, a bracket member for attachment to one of the bed rails with the bracket member for receiving one of the ends of the L-shaped cross bar member, and a leg member for attachment to horizontal flange and the vertical flange of the L-shaped cross bar member for supporting the L-shaped cross bar member.

In yet another form of the present disclosure, a cross bar system for supporting a bed having a pair of bed rails comprises an L-shaped cross bar member having a horizontal flange, a vertical flange, a first end, and a second end, a first bracket member for attachment to one of the bed rails and a second bracket member for attachment to the other one of the bed rails with each of the bracket members for receiving one of the ends of the L-shaped cross bar member, and a leg member for attachment to horizontal flange and the vertical flange of the L-shaped cross bar member for supporting the L-shaped cross bar member.

In light of the foregoing comments, it will be recognized that a principal object of the present disclosure is to provide a cross bar system for supporting a bed which is of simple construction and design and which can be easily employed with highly reliable results.

Another object of the present disclosure is to provide a cross bar system for supporting a bed that employs lightweight structures or components.

A further object of the present disclosure is to provide a cross bar system for supporting a bed that is capable of being manufactured using commonly available components that are relatively inexpensive.

Another object of the present disclosure is to provide a cross bar system for supporting a bed that can be shipped in a compact form and container.

Yet another object of the present disclosure is to provide a cross bar system for supporting a bed that has increased strength, reliability, and durability.

A still further object of the present disclosure is to provide a cross bar system for supporting a bed that has height adjustable leg supports.

These and other objects and advantages of the present disclosure will become apparent after considering the following detailed specification in conjunction with the accompanying drawings, wherein

DETAILED DESCRIPTION OF THE EMBODIMENTS

Figure 1:
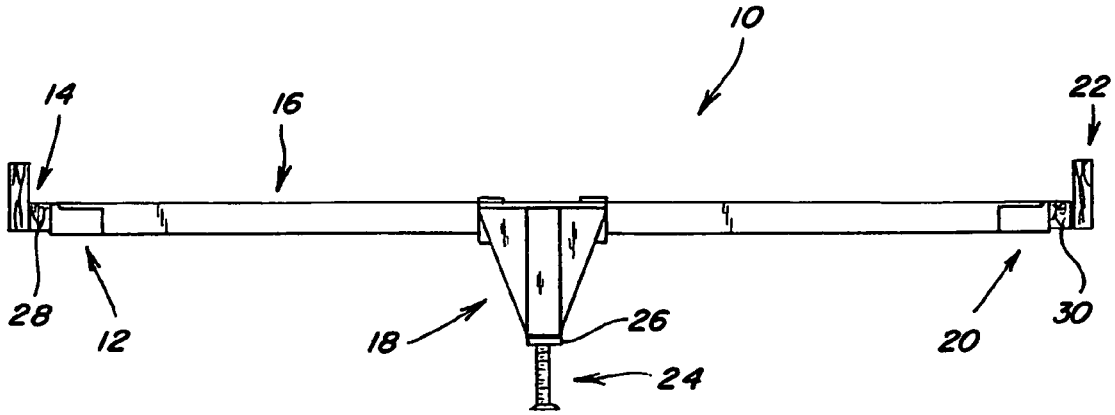
FIG. 1 is a perspective view of an embodiment of a cross bar system for supporting a bed constructed according to the present disclosure.

Referring now to the drawings, wherein like numbers refer to like items, number 10 identifies an embodiment of a cross bar system for supporting a bed constructed according to the present disclosure. With reference now to FIG. 1, the cross bar system 10 is shown comprising a first bracket member 12 mounted to a first bed rail 14, a cross bar member 16 mounted to the first bracket member 12, and a leg member 18 mounted to the cross bar member 16. The system 10 may also comprise a second bracket member 20 mounted to a second be rail 22 with the cross bar member 16 mounted to the second bracket member 20. The cross bar member 16 is sized to span the width of a particular shaped bed (not shown) such as a full, queen, kings or California king sized bed. In this manner, the leg member 18 will support the cross bar member 16. The leg member 18 comprises a threaded glide member 24 inserted into a threaded insert 26 that fits in the leg member 18. The threaded glide member 24 may be adjusted up or down in order to level the leg member 18. Also, the leg member 18 is capable of sliding along the cross bar member 16, as will be discussed more fully herein. It is also possible and contemplated that more than one leg member 18 may be installed on the same cross bar member 16 to add further support to the cross bar member 16. For example, a king sized bed is wider than a full sized bed and this may require more than one leg support to prop up the cross bar member 16 along the entire span of the cross bar member 16. The bed rails 14 and 22 are typically constructed from wood and the bracket members 12 and 20 may be screwed or otherwise secured to the rails 14 and 22, as will be explained herein. The bed rails 14 and 22 each have a cleat 28, and 30, respectively, to which the bracket members 12 and 20 are mounted.

With reference now to FIG. 24, the first bracket member 12 is illustrated. The first bracket member 12 comprises a first flange 40, a second flange 42, and a hanger portion 44 between the flanges 40 and 42. The first flange 40 has an upper portion 46, an intermediate offset portion 48, and a lower portion 50. The upper portion 46 also has an aperture or opening 52 which is sized to receive a screw (not shown) such as a wood screw or other fastening type device. As previously indicated, the screw is used to secure or mount the first bracket member 12 to the wooden bed rail 14. The wooden bed rail 14 may be predrilled to receive the screw.

The second flange 42 has an upper portion 54, an offset portion 56, and a lower portion 58. The upper portion 54 has an opening 60 that allows a screw to be inserted therein. Although not described previously, the opening 60 may be chamfered or beveled to permit a head of a screw to be flush with the upper portion 54. The upper portion 54 is placed on the cleat 28 of the bed rail 14 and secured in place.

The hanger portion 44 is centered between the flanges 40 and 42 and includes a slot 62 for receiving one end of the cross bar member 16. The bracket 12 also comprises a pair of anti-crack grooves 64 and 66. The grooves 64 and 66 facilitate the manufacturing of the bracket 12. The bracket 20 is the same as the bracket 12 and the bracket 20 comprises the same component parts. Also, the brackets 12 and 20 are constructed from metal.

FIGS. 5-9 illustrate the leg member 18 without the glide member 24 or the threaded insert 26 being installed. The leg member 18 comprises a top portion 80 having a horizontal track 82. The horizontal track 82 may comprise a first track portion 84 and a second track portion 86. The track portions 84 and 86 are U-shaped in configuration. As can be appreciated, although two track portions 84 and 86 are shown it is also possible to have one track portion that extends along the entire length of the top portion 80. The top portion 80 has an opening 88. The leg member 18 further comprises a side portion 90 connected to the top portion 80 and extending downwardly from the top portion 80 and a vertical track 92 that extends along the entire length of the side portion 90. The vertical track 92 is U-shaped in construction. It is also contemplated that the vertical track 92 may comprise two or more track portions.

The leg member 18 also comprises a central hollow portion 94 having a pair of ribs 96 and 98. The ribs 96 and 98 are angled inwardly from the top portion 80 down to a bottom 100. The bottom 100 has an opening 102 (FIGS. 6 and 9) that is sized and shaped for receiving the threaded insert 26. The opening 102 and the opening 88 are aligned with each other.

Figure 6:
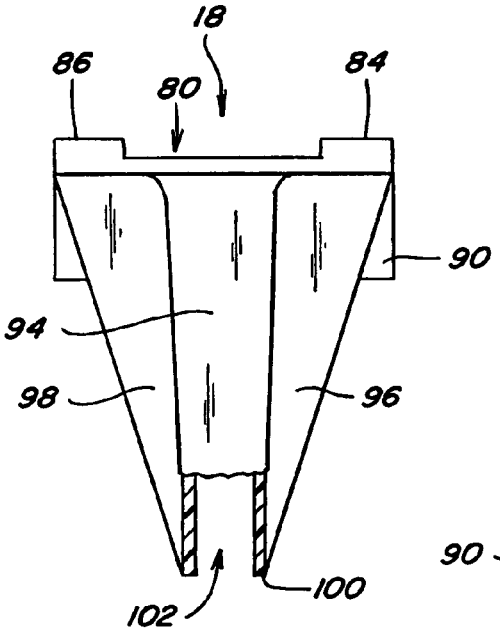
FIG. 6 is a back view of the leg member shown in FIG. 5 shown partially cut away.
Figure 7:
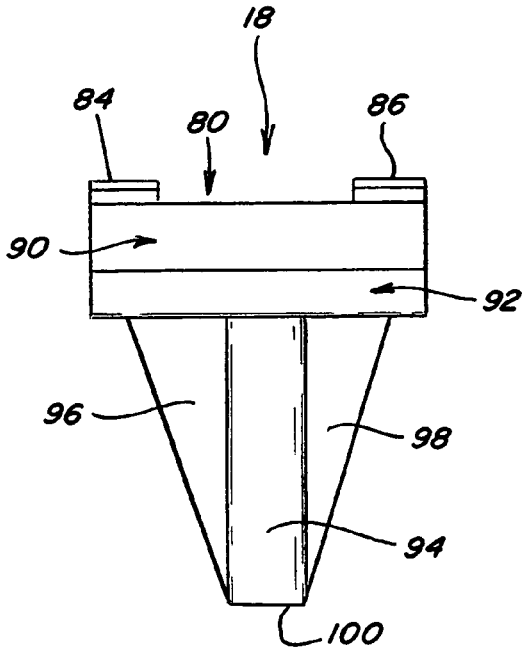
FIG. 7 is a front view of the leg member shown in FIG. 5.
Figure 8:
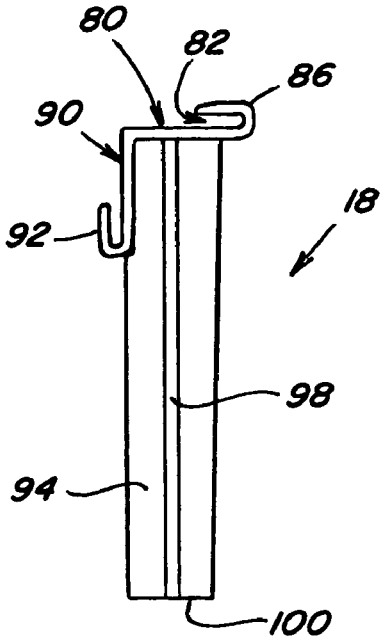
FIG. 8 is a side view of the leg member shown in FIG. 5.
Figure 9:
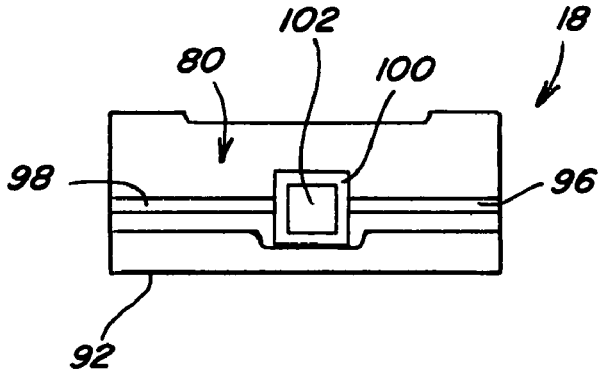
FIG. 9 is a bottom view of the leg member shown in FIG. 5.

With particular reference now to FIG. 6, a back view of the leg member 18 is shown having a portion of the central portion 94 cut away to illustrate that the central portion 94 is hollow. The opening 102 is sized to allow the threaded insert 26 to be placed therein. The leg member 18 is preferably made from high density polyethylene. The leg member 18 is strong and can support weights of at least 2,300 pounds. It is also possible that the leg member 18 may be constructed from other materials such as metal or other high strength plastics.

Figure 10:
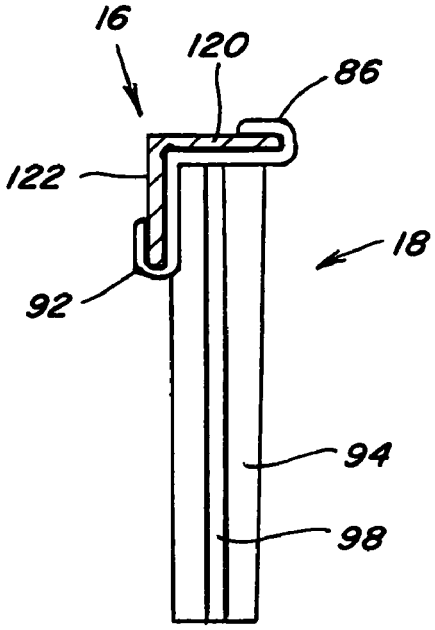
FIG. 10 is a side view of the leg member installed on a cross bar member with the cross bar member shown in cross section.

FIG. 10 depicts the leg member 18 mounted to the cross bar member 16. The cross bar member 16 is an angle iron or an L-shaped piece of metal. The cross bar member 16 has a horizontal flange 120 and a vertical flange 122. The second track portion 86 of the horizontal track 82 is adapted to engage the horizontal flange 120 of the cross bar member 16. The vertical track 92 is adapted to engage the vertical flange 122 of the cross bar member 16. In the manner, the leg member 18 may be positioned on the cross bar member 16 by sliding the track portions 84 and 86 of the horizontal track 82 onto the horizontal flange 120 and the vertical track 92 onto the vertical flange 122. The leg member 18 may be positioned anywhere along the entire length of the cross bar member 16. In view of this, it is possible to place one or more of the leg members 18 along the cross bar member 16 for supporting the cross bar member 16.

Figure 11:
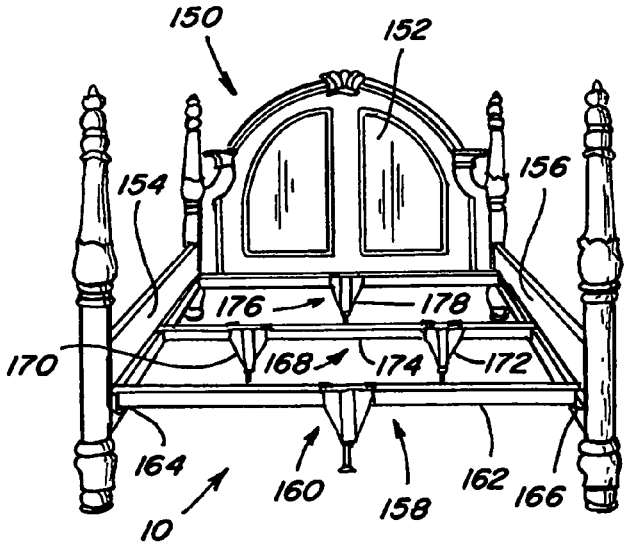
FIG. 11 is a front perspective view of the cross bar system installed on a bed.

Referring now to FIG. 11, the cross bar system 10 is shown being installed on a bed 150. The bed 150 consists of a headboard 152 and a pair of side rails 154 and 156. Other components of the bed 150 which are not shown may include a footboard, a mattress, and a box spring for supporting the mattress. The bed 150 is shown to have a first cross bar system 158 installed on the side rails 154 and 156. In particular, the first cross bar system 158 comprises a leg member 160 that is engaged with a cross bar member 162 with the cross bar member 162 being hung on a pair of bracket members 164 and 166. A second cross bar system 168 is also installed on the bed 150. The second cross bar system 168 comprises a pair of leg members 170 and 172 fit into place on a cross bar member 174. As can be appreciated, the leg members 170 and 172 can be positioned anywhere on the cross bar member 174 by sliding either or both of the leg members 170 and 172 along the length of the cross bar member 174. Also, it is possible to have more than two leg members 170 and 172 on the cross bar member 174 in the case where more support is required. A third cross bar system 176 is used with the bed 150. The third cross bar system 176 is positioned near the headboard 152. The third cross bar system 176 uses one leg member 178. Depending on the size of the bed 150, it is also contemplated to include more that the three cross bar systems 158, 168, and 176.

In operation, the bracket members 164 and 166 are screwed onto the side rails 154 and 156, respectively, by use of screws or other fastening devices. For example, the bracket members 164 and 166 may be positioned 63" away from the headboard 152. The leg member 160 is then placed onto the cross bar member 162 and may be centered on the member 162. The glide 24 may be adjusted to allow the cross bar member 162 to sit flush with the top of the side rails 154 and 156 and to have the glide 24 touch the floor. The cross bar member 162 including the leg member 160 is then inserted into the bracket members 164 and 166. The other cross bar systems 168 and 176 are installed in a similar manner.

As can be realized, the cross bar system 10 is applicable for use with full, queen, kings and California king size beds. The leg member 18 and the bracket members 12 and 20 may fit any size bed. The cross bar member 16 has to be the width of the particular sized bed. In this manner, a store may stock leg members 18 and bracket members 12 and 20 and have various sized cross bar members 16 for the various beds that are sold. Also, the store may stock one size of a cross bar member 16, for example the widest width possible for a bed, and then cut the cross bar member 16 to length depending upon which bed is purchased. By using the bracket members 12 and 20 the cross bar member 16 does not have to have holes punched therein at each end and this reduces the cost for a cross bar system. Further, the hanger portion 44 of the bracket member 12 allows for some tolerance in the length of the cross bar member 16. For example, the cross bar member 16 for a standard king size bed may have a length of between 75½" to 77½" and the hanger portion 44 will be able to accept this cross bar member 16.

Figure 12:
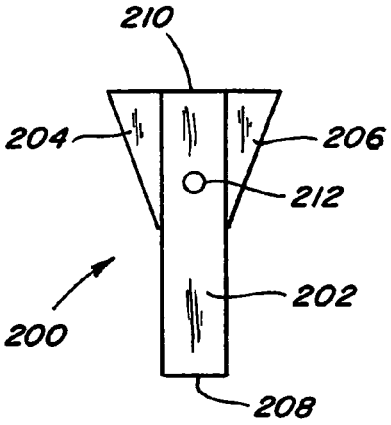
FIG. 12 is a front perspective view of an extension leg member.

FIG. 12 shows a perspective view of an extension leg member 200 that may be used to increase the height of the cross bar system 10. For example, the side rails on a bed may be higher than is typical due to the side rails being placed on the headboard and footboard at a higher than typical height. In this situation the leg member 18 will not be long enough for the threaded glide member 24 to touch the floor. In order to compensate for the difference in height, the extension leg member 200 is used. The extension leg member 200 comprises a central hollow portion 202 having a pair of hollow rib members 204 and 206. The hollow rib members 204 and 206 are used to capture the ribs 96 and 98 when a leg member 18 is inserted into the extension leg member 200. The extension leg member 200 has a bottom portion 208 that has an opening (not shown) that is sized and shaped to receiving a threaded insert 26. The extension leg member 200 also has a top portion 210 that is adapted to receive a leg member 18. An aperture or opening 212 is formed in the extension leg member 200 whose function will be explained more fully herein.

Figure 13:
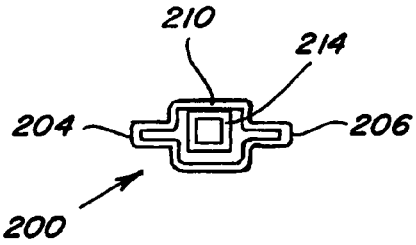
FIG. 13 is a top view of the extension leg member shown in FIG. 12.

With particular reference now to FIG. 13, a top view of the top portion 210 of the extension leg member 200 is illustrated. The top portion 210 is open and is sized and shaped to receive and hold a leg member 18 inserted therein. The extension leg member 200 also has a stop portion 214 that is used to rest the bottom 100 of the leg member 18.

Figure 14:
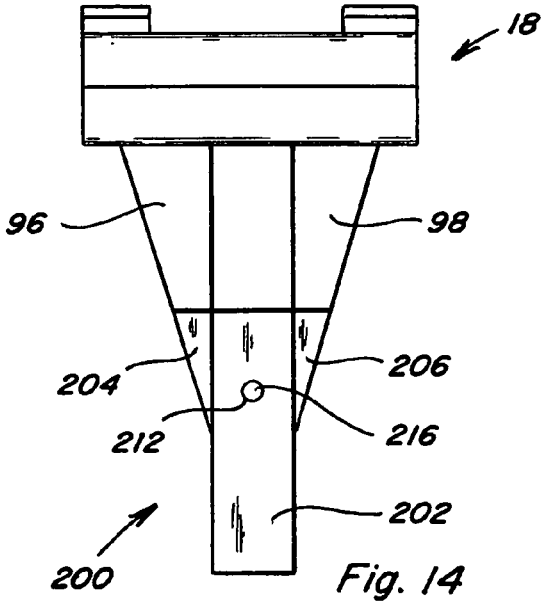
FIG. 14 is a front perspective view of a leg member receiving the extension leg member.

FIG. 14 shows a leg member 18 inserted into the extension leg member 200. The extension leg member 200 is sized and shaped to receive and hold the leg member 18 in place. The rib members 204 and 206 receive the ribs 96 and 98, respectively. The central hollow portion 94 of the leg member 18 is also aligned with the central hollow portion 202 of the extension leg member 200. The leg member 18 also has a protrusion or bump 216 that is adapted to mate with the opening 212 of the extension leg member 200. In this manner the opening 212 and the bump 216 lock the leg member 18 and the extension leg member 200 together. Locking the leg member 18 and the extension leg member 200 together prevents the members 18 and 200 from separating when installing the system 10. Although not shown, a threaded guide member 24 and a threaded insert 26 may be used with the extension leg member 200.

From all that has been said, it will be clear that there has thus been shown and described herein a cross bar system which fulfills the various objects and advantages sought therefore. It will become apparent to those skilled in the art, however, that many changes, modifications, variations, and other uses and applications of the subject cross bar system are possible and contemplated. All changes, modifications, variations, and other uses and applications which do not depart from the spirit and scope of the disclosure are deemed to be covered by the disclosure, which is limited only by the claims which follow.

What is claimed is:

1. A cross bar system for a bed having a pair of bed rails, the system comprising:

a cross bar member;

a bracket member for attachment to one of the bed rails with the bracket member for receiving the cross bar member, the bracket member comprising a first flange having an upper portion, an intermediate offset portion, and a lower portion, a second flange having an upper portion, an intermediate offset portion, and a lower portion, a hanger portion between the first and second flanges, a first anti-crack groove between the first flange and the hanger portion, and a second anti-crack groove between the second flange and the hanger portion; and a leg member for attachment to the cross bar member for supporting the cross bar member.

2. The cross bar system of claim 1 wherein the leg member comprises a central portion having a pair of ribs.

3. The cross bar system of claim 1 wherein the hanger portion is adapted for receiving the cross bar member.

4. The cross bar system of claim 1 wherein the first flange has an opening for receiving a screw and the second flange has an opening for receiving a screw.

5. The cross bar system of claim 1 wherein the leg member comprises a top portion, a bottom portion, a central portion, and a pair of ribs with the ribs being angled inwardly from the top portion down to the bottom portion.

6. The cross bar system of claim 1 wherein the leg member has a bottom and the cross bar system further comprising an extension leg member that is adapted to receive the bottom of the leg member.

7. The cross bar system of claim 1 wherein the leg member comprises a top portion having a horizontal track with the horizontal track for engaging the cross bar member.

8. The cross bar system of claim 7 wherein the leg member further comprises a side portion connected to the top portion and extending downwardly from the top portion and a vertical track member with the vertical track member for engaging the cross bar member.

9. A cross bar system for supporting a bed having a pair of bed rails, the system comprising:

an L-shaped cross bar member having a horizontal flange, a vertical flange, a first end, and a second end;

a bracket member for attachment to one of the bed rails with the bracket member for receiving one of the ends of the L-shaped cross bar member, the bracket member comprising a first flange having an upper portion, an intermediate offset portion, and a lower portion, a second flange having an upper portion, an intermediate offset portion, and a lower portion, a hanger portion between the first and second flanges, a first anti-crack groove between the first flange and the hanger portion, and a second anti-crack groove between the second flange and the hanger portion; and a leg member for attachment to the horizontal flange and the vertical flange of the L-shaped cross bar member for supporting the L-shaped cross bar member.

10. The cross bar system of claim 9 wherein the leg member comprises a central portion having a pair of ribs.

11. The cross bar system of claim 9 wherein the first and second flanges are adapted for being placed on one of the bed rails.

12. The cross bar system of claim 9 wherein the hanger portion is adapted for receiving the vertical flange of the L-shaped cross bar member.

13. The cross bar system of claim 9 wherein the leg member comprises a top portion, a bottom portion, a central portion, and a pair of ribs with the ribs being angled inwardly from the top portion down to the bottom portion.

14. The cross bar system of claim 9 wherein the leg member comprises a top portion having a horizontal track with the horizontal track for engaging the horizontal flange of the L-shaped cross bar member.

15. The cross bar system of claim 14 wherein the leg member further comprises a side portion connected to the top portion and extending downwardly from the top portion and a vertical track with the vertical track for engaging the vertical flange of the L-shaped cross bar member.

16. A cross bar system for supporting a bed having a pair of bed rails, the system comprising:

an L-shaped cross bar member having a horizontal flange, a vertical flange, a first end, and a second end;

a first bracket member for attachment to one of the bed rails and a second bracket member for attachment to the other one of the bed rails with each of the bracket members for receiving one of the ends of the L-shaped cross bar member;

a leg member for attachment to the horizontal flange and the vertical flange of the L-shaped cross bar member for supporting the L-shaped cross bar member, the leg member comprising a central portion having a protrusion; and an extension leg member for mating with the leg member, the extension leg member comprising an opening for receiving the protrusion for securing the leg and the extension leg member together.

17. The cross bar system of claim 16 wherein the central portion has a pair of ribs.

18. The cross bar system of claim 16 wherein the leg member comprises a top portion having a horizontal track with the horizontal track for engaging the horizontal flange of the L-shaped cross bar member.

19. The cross bar system of claim 18 wherein the leg member further comprises a side portion connected to the top portion and extending downwardly from the top portion and a vertical track with the vertical track for engaging the vertical flange of the L-shaped cross bar member.

20. The cross bar system of claim 16 wherein the extension leg member comprises a central portion having an opening at an end adapted for receiving a threaded insert and a threaded guide member.

* * * * *

UNITED STATES PATENT AND TRADEMARK OFFICE

CERTIFICATE OF CORRECTION

Figure 2:
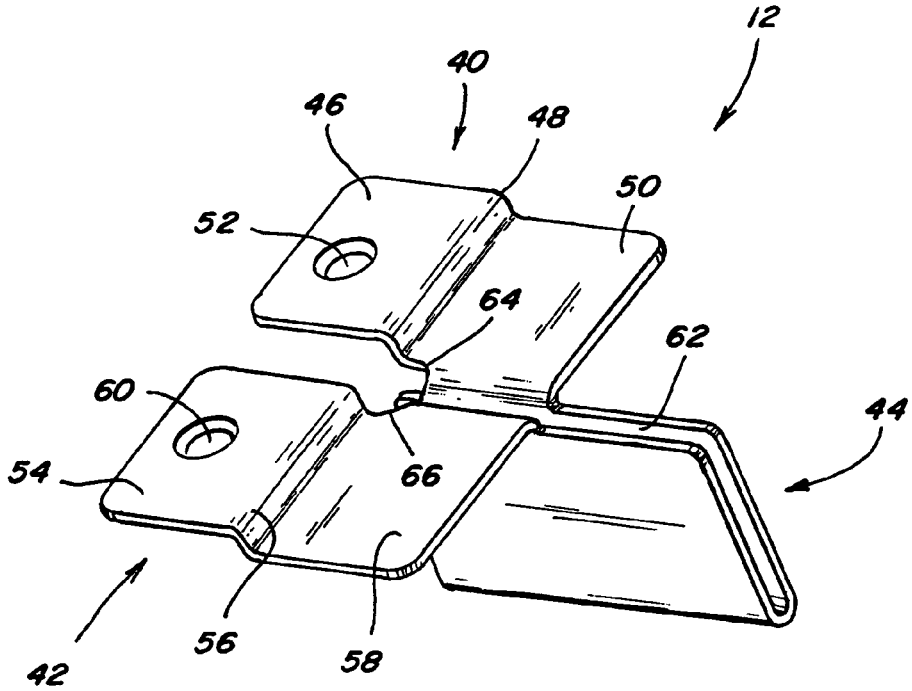
FIG. 2 is a side perspective view of a bracket member constructed according to the present disclosure.
Figure 3:
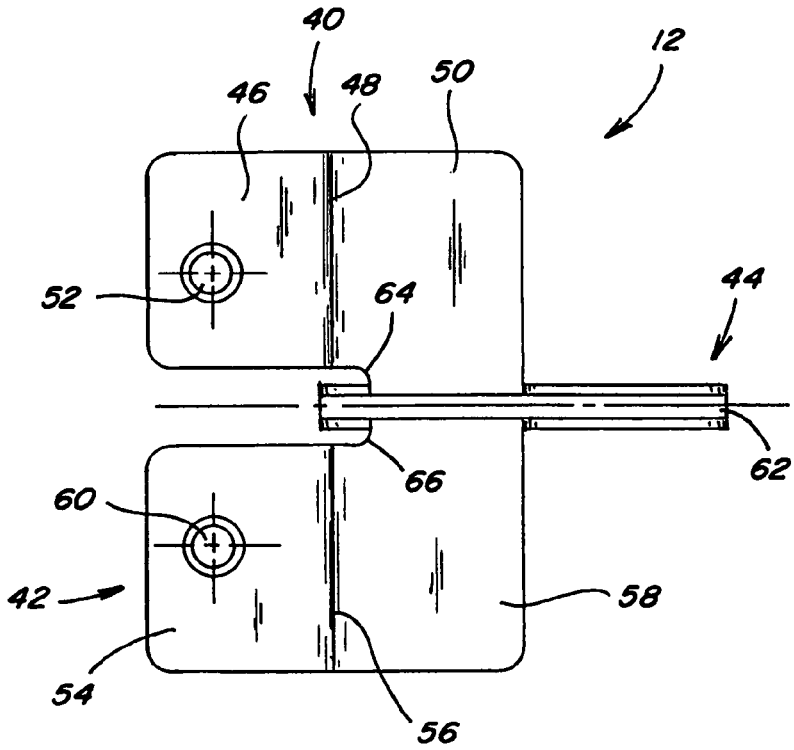
FIG. 3 is a top view of the bracket member shown in FIG. 2.
Figure 4:
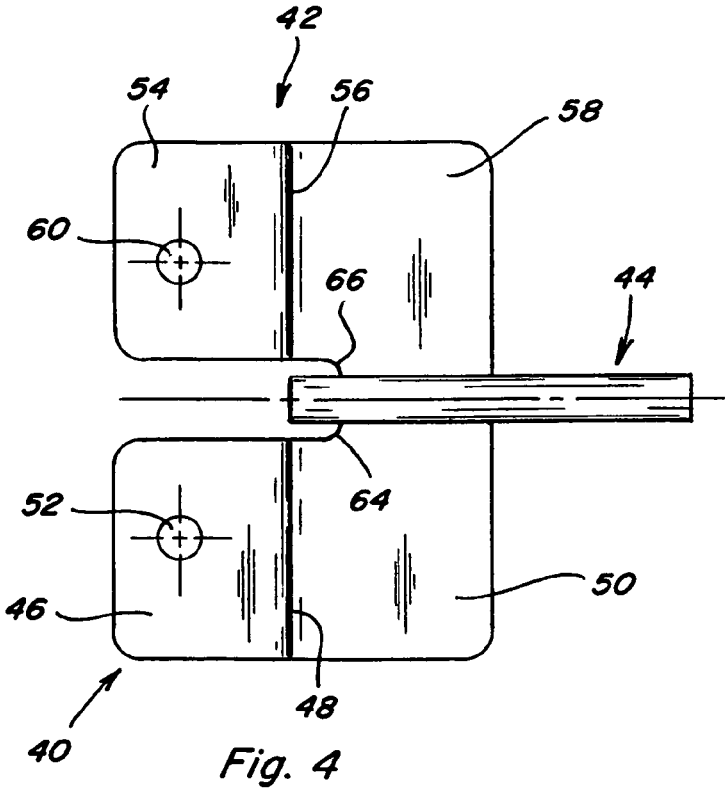
FIG. 4 is a bottom view of the bracket member shown in FIG. 2.
Figure 5:
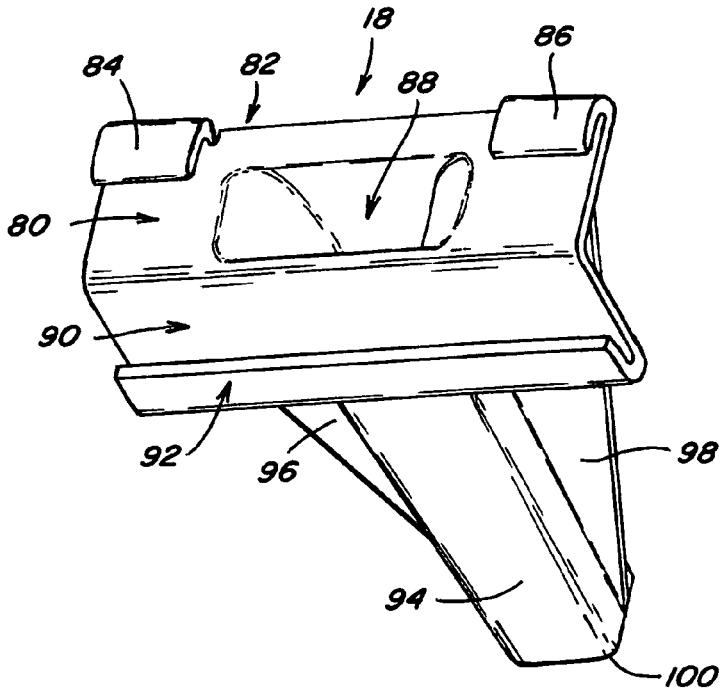
FIG. 5 is a top perspective view of a leg member constructed according to the present disclosure.

PATENT NO. : 7,895,687 B2
APPLICATION NO. : 12/321588
DATED : March 1, 2011
INVENTOR(S) : John K. Schulte It is certified that error appears in the above-identified patent and that said Letters Patent is hereby corrected as shown below:

Column 3, line 45, "FIG. 24" should be --FIGS. 2-4--.

Signed and Sealed this
Tenth Day of May, 2011

David J. Kappos

David J. Kappos
*Director of the United States Patent and Trademark Office*